US007494020B2

(12) United States Patent
Shan et al.

(10) Patent No.: US 7,494,020 B2
(45) Date of Patent: Feb. 24, 2009

(54) LIFTING MACHINERY OF FOUR REEL DIFFERENTIAL TYPE FOR TWO 40 FEET CONTAINER SHORE CRANE

(75) Inventors: Jianguo Shan, Shanghai (CN); Baohua Zhang, Shanghai (CN)

(73) Assignee: Shanghai Zhenhua Port Machinery Co., Ltd., Shanghai (CN)

( * ) Notice: Subject to any disclaimer, the term of this patent is extended or adjusted under 35 U.S.C. 154(b) by 0 days.

(21) Appl. No.: 11/388,780

(22) Filed: Mar. 24, 2006

(65) Prior Publication Data

US 2006/0240933 A1 Oct. 26, 2006

(30) Foreign Application Priority Data

Apr. 6, 2005 (CN) ..... 2005 1 0024906

(51) Int. Cl.
*B66C 13/04* (2006.01)

(52) U.S. Cl. ..... 212/274

(58) Field of Classification Search ..... 212/274
See application file for complete search history.

(56) References Cited

U.S. PATENT DOCUMENTS

| | | | |
|---|---|---|---|
| 3,689,106 | A | 9/1972 | Young |
| 3,807,582 | A | 4/1974 | Anderson |
| 3,812,987 | A | 5/1974 | Watatani |
| 3,837,503 | A | 9/1974 | Komatsu |
| 3,888,536 | A | 6/1975 | Durenec |
| 4,035,010 | A | 7/1977 | Kawashita et al. |
| 4,244,615 | A | 1/1981 | Brown |
| 4,563,030 | A | 1/1986 | Makino |
| 4,682,926 | A | 7/1987 | Chambers et al. |
| 4,755,099 | A | 7/1988 | Belveal |
| 4,973,219 | A | 11/1990 | Brickner et al. |
| 4,995,783 | A | 2/1991 | Petitto et al. |

(Continued)

FOREIGN PATENT DOCUMENTS

| | | |
|---|---|---|
| CN | 2225462 | 4/1996 |

(Continued)

*Primary Examiner*—Thomas J. Brahan
(74) *Attorney, Agent, or Firm*—Dorsey & Whitney LLP

(57) ABSTRACT

The invention relates to a lifting machinery of four reel differential type for two 40 feet container shore crane comprising: motors, reductors, high speed brakes, reels and reel brakes; wherein at least one motor is provided; the reductor connected at the motor output end is a planetary differential reductor having a plurality of high speed input shafts, low speed output shafts and the differential project shafts; the high speed input shaft connects to the motor output shaft, at least one high speed brake is provided on the high speed input shaft; four two-project rope reels are connected to the four low speed output shaft; at least one reel brake is provided to each reel; and a differential shaft brake consisting of at least two differential shaft brakes provided on two differential project shaft is also included; the revolution of the two differential project shaft of the planetary differential reductor is controlled by the two differential shaft brakes so that power of the planetary differential reductor may be distributed, and both the synchronous operation of two hanger tool or the separate operation of a single hanger tool can be carried out. The present invention meets the loading and unloading requirement and increases the loading and unloading efficiency of the container crane by more than 60%.

6 Claims, 2 Drawing Sheets

U.S. PATENT DOCUMENTS

| | | | |
|---|---|---|---|
| 5,039,275 | A | 8/1991 | Ide |
| 5,183,305 | A | 2/1993 | Nordstrom et al. |
| 5,671,912 | A | 9/1997 | Langford et al. |
| 5,718,550 | A | 2/1998 | Lanigan et al. |
| 5,775,866 | A | 7/1998 | Tax et al. |
| 5,871,249 | A | 2/1999 | Williams |
| 5,923,270 | A | 7/1999 | Sampo et al. |
| 5,951,226 | A | 9/1999 | Fantuzzi |
| 6,145,680 | A | 11/2000 | Jussila et al. |
| 6,312,213 | B1 | 11/2001 | Stinis |
| 6,354,782 | B1 | 3/2002 | Barry |
| 6,602,036 | B2 | 8/2003 | Takehara et al. |
| 6,698,990 | B1 | 3/2004 | Dobner et al. |
| 6,715,977 | B2 | 4/2004 | Dobner et al. |
| 6,920,963 | B2 | 7/2005 | Faller |
| 7,032,763 | B1 | 4/2006 | Zakula, Sr. et al. |
| 2002/0044854 | A1 | 4/2002 | Franzen et al. |
| 2003/0168871 | A1 | 9/2003 | Geis |
| 2003/0189348 | A1 | 10/2003 | Lindstrom |
| 2004/0032140 | A1 | 2/2004 | Solstad |
| 2005/0036854 | A1 | 2/2005 | Takehara et al. |
| 2006/0043748 | A1 | 3/2006 | Stinis et al. |

FOREIGN PATENT DOCUMENTS

| | | | |
|---|---|---|---|
| CN | 1155664 | | 7/1997 |
| CN | 2373421 | | 4/2000 |
| CN | 1415529 | | 5/2003 |
| CN | 1448331 | | 10/2003 |
| CN | 2599327 | | 1/2004 |
| CN | 2628508 | | 7/2004 |
| CN | 1579916 | | 2/2005 |
| DE | 1274299 | B | 8/1968 |
| DE | 38 38 058 | A1 | 5/1990 |
| EP | 1 650 156 | A | 4/2006 |
| FR | 828297 | A | 5/1938 |
| GB | 876647 | A | 9/1961 |
| JP | 55-035722 | A | 3/1980 |
| JP | 60153331 | | 8/1985 |
| JP | 01294121 | | 11/1989 |
| JP | 05097251 | | 4/1993 |
| JP | 8 175784 | A | 7/1996 |
| JP | 9-267987 | | 10/1997 |
| JP | 10-324493 | | 12/1998 |
| JP | 2001/240372 | A | 9/2001 |
| JP | 2002068481 | A | 3/2002 |
| WO | WO 98/34127 | | 8/1998 |
| WO | WO 01/58797 | A1 | 8/2001 |
| WO | WO 01/98195 | | 12/2001 |
| WO | WO 01/98195 | A1 | 12/2001 |
| WO | WO 2005/009885 | A1 | 2/2005 |

LIFTING MACHINERY OF FOUR REEL DIFFERENTIAL TYPE FOR TWO 40 FEET CONTAINER SHORE CRANE

CROSS-REFERENCE TO RELATED APPLICATION

This application claims priority to Chinese patent application 200510024906.8, filed 6 Apr. 2005, the subject matter of which are hereby incorporated by reference in its entirety.

FIELD OF INVENTION

The invention generally relates to a lifting machinery for crane, more particularly, relates to a lifting machinery of two reel differential type for two 40 feet container shore crane.

BACKGROUND OF INVENTION

The increasing requirements of container transportation in the world and the continuous increment of the handling capacity of the container port put forward new and increased demands on the technical equipment for loading and unloading containers, and an urgent need for the design and development of high efficient bank-run container load and unload systems to meet the demand of the lifter productivity needed by the larger ships.

The main lifting machinery of the crane of the prior art carries out the lifting and lowering operation of one hanger tool only, hence only one 40 feet container or two 20 feet containers can be lifted at a time so that limits the production efficiency and does not meet the market requirement.

SUMMARY OF INVENTION

It is an object of the present invention to provide a lifting machinery for four reel differential type for two 40 feet container shore crane so that the lifting machinery with a set of motors and reductors can lift two 40 or 45 feet containers (or four 20 feet containers) simultaneously, achieving both the synchronous operation of two hanger tools and the operation of single hanger tool. The loading and unloading efficiency may be increased by more than 60%, thus the present invention can meet the requirements of the increasing demand on loading and unloading efficiency of the ship transportation industry.

According to the present invention, providing a lifting machinery of four reel differential type for two 40 feet container shore crane, comprising: a motor; a reductor connecting to the output shaft of the motor; a high speed brake provided at the input end of the reductor; a plurality of two-project rope reels connecting to the output ends of the reductor; and a plurality of reel barkers connecting to each of the two-project rope reels; wherein, at least one motor is provided; a planetary differential reductor is used as said reductor bconnecting to the output end of the motor, the planetary differential reductor has a plurality of low speed output shafts, a plurality of high speed input shafts and a plurality of differential project shafts controlling the power distribution; the output shaft of the motor connects to the high speed input shaft of the planetary differential reductor, and at least one high speed brake is provided on the high speed input shaft of the planetary differential reductor; each of the two-project rope reels connects to the low speed output shaft of the planetary differential reductor; and at least one reel brake is provided on each of the two-project rope reels; a differential shaft brake controlling the power distribution of the planetary differential reductor, connects to the differential project shaft of the planetary differential reductor.

According to an embodiment of the present invention, said planetary differential reductor provided at the output end of the motor has a land side output and a sea side output being placed in its front and rear respectively; the land side output has two low speed output shafts connecting to one of the two two-project rope reels of the land side respectively, the two two-project rope reels have four project ropes connecting to a hanger tool; the sea side output as two low speed output shafts connecting to one of the two two-project rope reels of the sea side respectively; the two two-project rope reels have four project ropes connecting to another hanger tool.

According to an embodiment of the present invention, two motors, a first motor and a second motor; the output shaft of the first motor connects to a high speed input shaft of the planetary differential reductor, and two high speed brakes are provided on the high speed input shaft of the planetary differential reductor; the output shaft of the second motor connects to another high speed input shaft of the planetary differential reductor, and two high speed brakes are provided on the high speed input shaft of the planetary differential reductor;

According to an embodiment of the present invention, one motor is provided, the output end of the motor connects to a high speed input shaft of the planetary differential reductor; and two high speed brake are provided on the high speed input shaft of the planetary differential reductor.

According to an embodiment of the present invention, two reel brakes are provided on each of the land side two two-project rope reels; and two rope reels brakes are provided on each of the sea side two-project rope reels.

According to an embodiment of the present invention, said differential shaft brake has a first differential shaft brake and a second differential shaft brake both controlling the power distribution of the planetary differential reductor, and each of the two differential shaft brakes connects to one of the two differential project shafts of the planetary differential reductor respectively.

Compared with the prior art, the lifting machinery of two reel differential type for two 40 feet container shore crane according to the invention has the following advantages and benefits:

1. The present invention uses a planetary differential reductor having two side outputs in stead of the reductor of the prior art, according to the present invention, a set of motors and reductors connect to two sets of lifting machineries to distribute the power to the reels by actual outer moment using the planetary differential redactor, so as to achieve the synchronous operation of two hanger tools, such as two 40 or 45 feet containers (or four 20 feet containers) simultaneously, increasing the landing and unloading efficiency of the container shore crane by more than 60%;

2. The invention uses a planetary differential reductor and two differential shaft brakes provided on the differential project shaft of the planetary differential reductor. By controlling the differential project shaft by using the two differential shaft brakes, the synchronous operation of two hanger tools or the operation of single hanger tool can be carried out in order to meet the requirement of the landing and unloading; for example, if all of the differential shaft brakes are in the close state and all of the reel brakes are in the open state, the power is distributed to each reel according to the actual outer twisting moment automatically so that the synchronous operation of two hanger tools is carried out;

if one differential shaft brake is in the close state and another differential shaft brake is in the open state, the revolution of the respective differential project shaft of the planetary differential reductor is restrained by the differential shaft brake in the close state, then the twisting moment is transferred onto the reel at a respective side, and the twisting moment is not transferred onto the reel at another side since the differential project shaft in the open state in not constrained, so shat the operation of single hanger tool can be carried out;

3. A set of the planetary differential reductor is used to drive two sets of the lift machineries, thus the amount of the equipment such as motors, actuators (reductors) etc, can be decreased, simplifying the structure, reducing the weight and facilitating the maintenance.

BRIEF DESCRIPTION OF DRAWINGS

The object, concrete structure, feature and advantage of the invention may be further understood from the following description of the several embodiment of the lift machineries of four reel differential type for two 40 feet container shore crane according to the invention referring to the appended drawings in which.

DETAILED DESCRIPTION OF PREFERRED EMBODIMENTS

Figure 1:
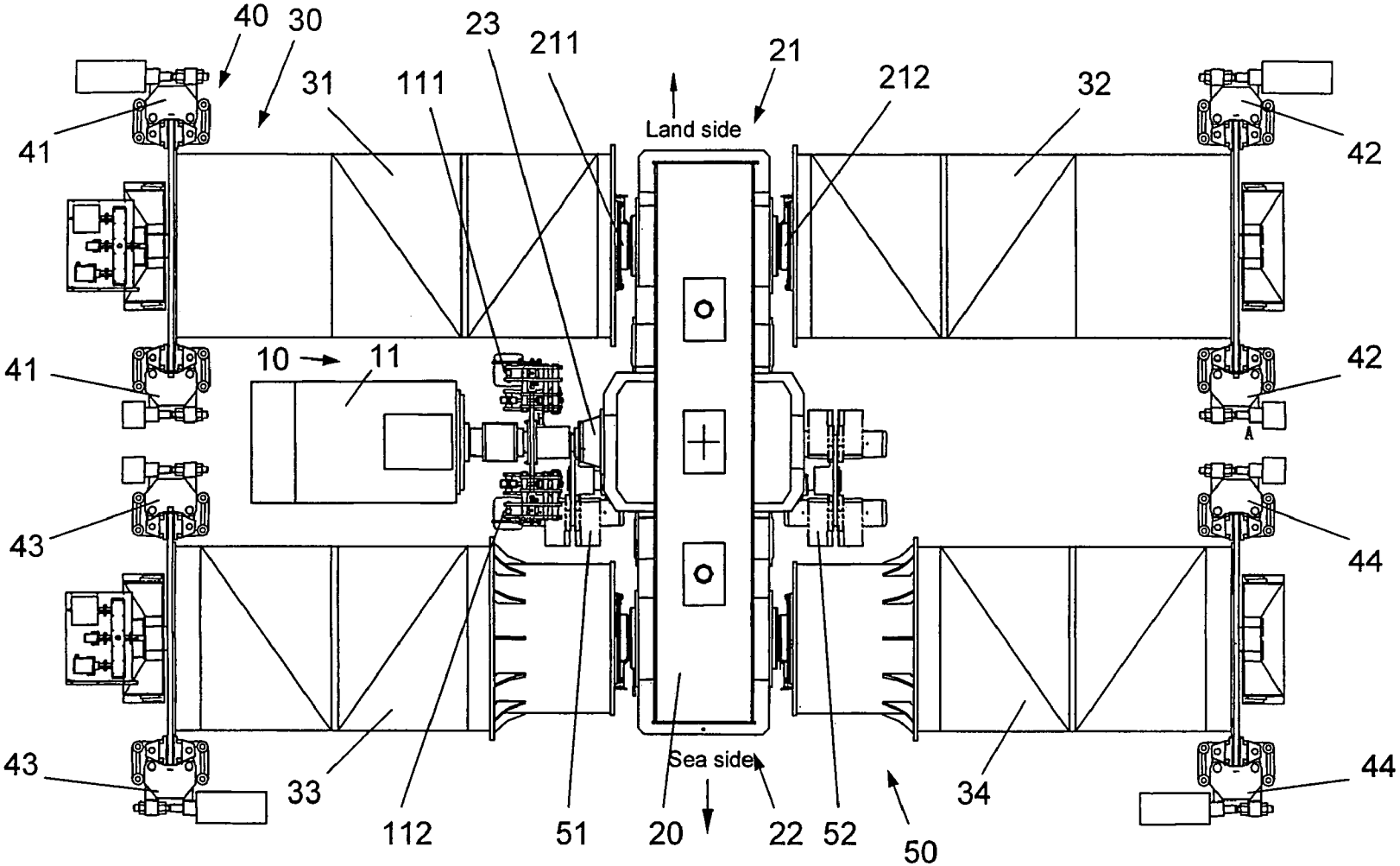
FIG. 1 is the schematic structure view of a first embodiment of the lifting machinery having two motors of four reel differential type for two 40 feet container shore crane according to the invention.
Figure 2:
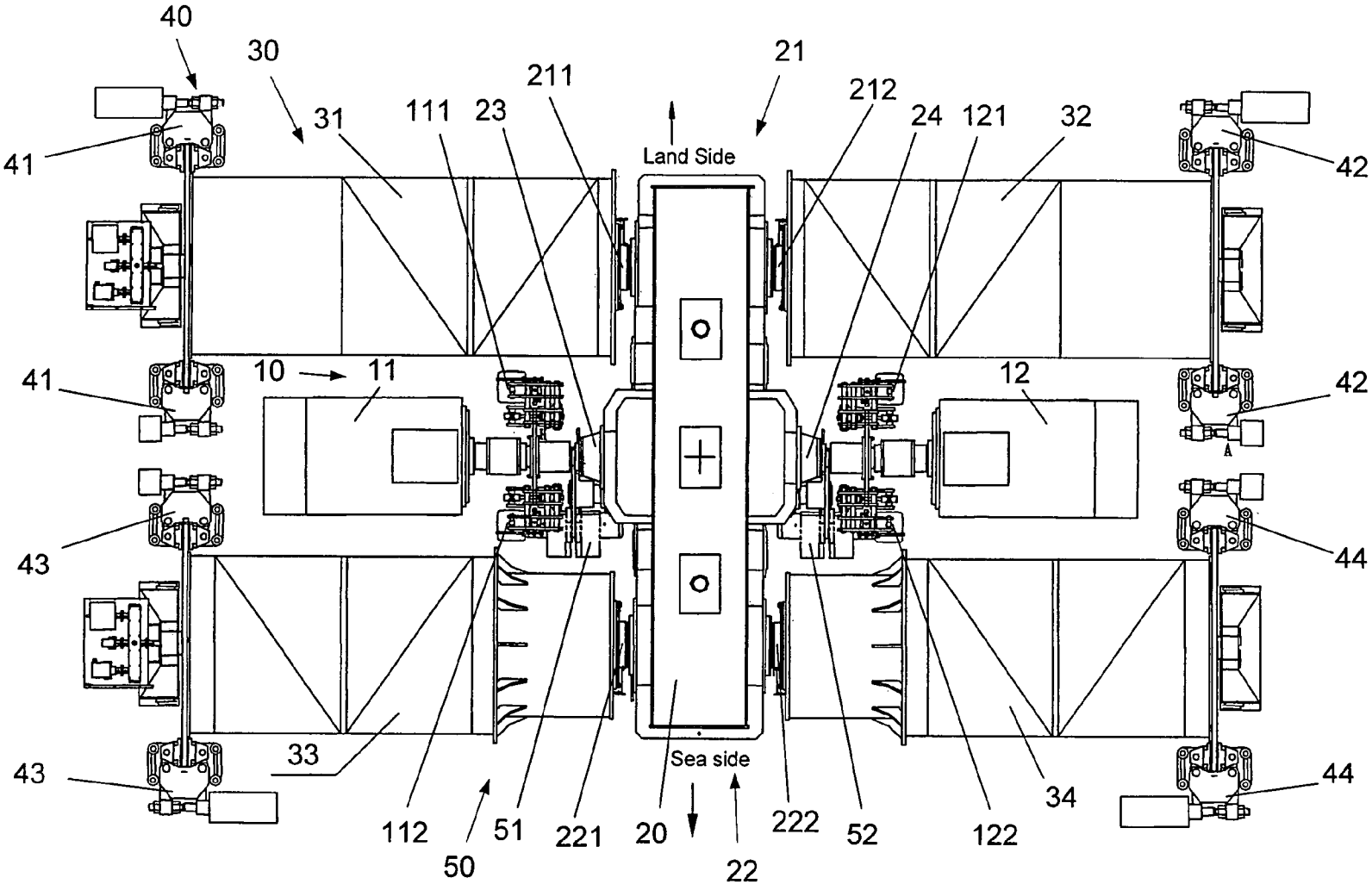
FIG. 2 is the schematic structure view of a second embodiment of the lifting machinery having a motor of four reel differential type for two 40 feet container shore crane according to the invention.

Referring to FIGS. 1, and 2, they are the schematic structure view of the lifting machinery of four reel differential type for two 40 feet container shore crane according to the invention. The lifting machinery of the invention includes: motor (s) 10, reductor(s) 20 connecting to the motor 10, high speed brake(s) 11 provided on the input end of the reductor 20, a plurality of two-project rope reels 30 connecting to the output end of the reductor 20, a plurality of reel brakes 40 provided on each two-project rope reel 30, and differential shaft brake (s) 50 connecting to the reductor 20, the differential shaft brake(s) 50 control the power distribution of the reductor 20.

One or two motors may be provided according to the power of the motors; according to the invention, a planetary differential reductor is used as the reductor 20 provided at the output end of the motor 10, the planetary differential reductor 20 has a plurality of high speed input shaft, a plurality of low speed output shaft and a plurality of differential project shafts controlling the power distribution. The output shaft of motor 10 is connected to the high speed input shaft of the planetary differential reductor 20, and at least one high speed brake 11 is provided on the high speed input shaft of the planetary differential reductor 20. Each on of the two-project rope reels is connected to one low speed output shaft of the planetary differential reductor 20 respectively. At least one reel brake is provided on each two-project rope reel 30. The differential shaft brake 50 controlling the power distribution of the planetary differential reductor 20 has a first differential shaft brake 51 and a second differential shaft brake 52, and for the purpose of controlling the land side hanger tool and the sea side hanger tool individually, the two differential shaft brakes 51 and 52 connect to one of the differential project shafts of the two planetary gear trains of the planetary differential reductor 20 respectively, The revolution of the differential project shafts of the two planetary trains of the planetary differential reductor 20 are controlled by the two differential shaft brakes 51 and 52, so the revolution of the land side two-project rope reel and the sea side two-project rope reel may be controlled simultaneously, or the revolution of the land side two-project rope reel and the sea side two-project rope reel may be controlled individually so as to achieving both the synchronous control of the land side hanger tool and the sea side hanger tool and the separate control of the land side hanger tool or the sea side hanger tool.

Refer to FIG. 1, FIG. 1 is the schematic view of a first embodiment of the lifting machinery of four reel differential type for two 40 feet container shore crane according to the invention, such lifting machinery has two motors. According to the embodiment, the crane lifting machinery of the invention comprises: a motor 10, a reductor 20, a plurality of two-project rope reels 30, a plurality of reel brakes 40 and a differential shaft brake 50.

According to the embodiment, two motors are provided, including a first motor 11 and a second motor 12. The planetary differential reductor 20 provided at the output end of motor 10 has a plurality of high speed input shafts, low speed output shafts and differential project shafts controlling the power distribution.

For the two high speed input shaft of said planetary differential reductor 20, the output shaft of the first motor 11 connects to a high speed input shaft 23 of the planetary differential reductor 20, and two high speed brakes 111 and 112 are provided on the high speed input shaft 23. The output shaft of the second motor 12 connects to another high speed input shaft 24 of the planetary differential reductor 20, and two high brakes 121 and 122 are provided on the high speed input shaft 24.

The planetary differential reductor 20 has a land side output 21 and a sea side output 22 with several low speed output shafts being placed in front and rear respectively. Each one of the low speed output shafts is used to drive the corresponding reel. According to the embodiment, the land side output 21 has two low speed output shafts 211 and 212 connecting to one of the two two-project rope reels 31 and 32 of the land side respectively, the two two-project rope reels 31 and 32 of the land side have four project ropes connecting to a hanger tool. The sea side output 22 has two low sheep output shafts 221 and 222 connecting to one of the two two-project rope reels 33 and 34 of the sea side respectively, the two two-project rope reels 33 and 34 of the sea side have four project ropes connecting another hanger tool. The revolution of two two-project rope reels 31 an 32 of the land side follows the revolution of the two low speed output shafts 211 and 212 of the land side of the planetary differential reductor 20; the revolution of two two-project rope reels 33 and 34 of the sea side follows the revolution of the two low speed output shafts 221 and 222 of the sea side of the planetary differential reductor 20.

The reel brakes 40 controlling the revolution of the two-project rope reel 30 are provided on said each two-project rope reel 30 respectively. For the purpose of carrying out the emergent braking of the land side and sea side two hanger tools and converting from lifting and lowering of two hanger tools simultaneously to lifting and lowering of one hanger tool, two reel brakes 40 are provided on each one of the two two-project rope reel 30, that is, two reel brakes 41 and 42 are provided on each one of the land side two two-project rope reel 31 and 32, and two reel brakes 43 and 44 are provided on each one of the sea side two two-project rope reel 33 and 34, according to the embodiment.

Said differential brake 50 provided on the differential project shaft of the planetary differential reductor 20 is used to control the power distribution of the planetary differential reductor 20. According to the invention, the differential shaft brake 50 controlling the deceleration has two differential shaft brakes, a first differential shaft brake 51 and a second differential shaft brake 52 both controlling the power distribution of the planetary machinery, each one of the two differential shaft brakes 51 and 52 connects to one of the differential project shafts of the planetary differential reductor 20 respectively so as to control the operation of each two-project rope reel of the land side and the sea side. Wherein, the first differential shaft brake 51 connects to a differential project shaft of the planetary differential reductor 20, the differential project shaft is used to control the operation of the two two-project rope reels 31 and 32 at one side; the second differential project shaft of planetary differential reductor 20, the differential project shaft is used to control the operation of the two two-project rope reels 33 and 34 at another side.

The differential shaft brake 50 controlling the planetary differential reductor as described above works as follows:

If the two differential shaft brakes 51 and 52 are in the braking state and all of the high speed shaft brakes 11 and the reel brakes 40 are in the open state, the power is distributed to the both sea side, land side reels depending on the outer twisting moment automatically;

If one differential shaft brake in the two planetary machinery differential shaft brakes 51 and 52 is in the open state and another differential shaft brake is in the braking state, the power is only transferred to the reel whose reel brake is in the open state, while another reel whose reel brake is in the braking state does not receive the moment of the motor;

Inversely, if the braking state and the open state of the two differential shaft brakes are interchanged, the power will be only transferred to another reel whose reel brake is in the open state and the reel in the opposite side whose reel brake is in the braking state does not receive the moment of the motor.

Refer to FIG. 2, FIG. 2 is the schematic structure view of the lifting machinery of four reel differential type for two 40 feet container shore crane according to the invention, such lifting machinery has one motor. According to the embodiment, the crane lifting machinery comprises: a motor 10, a reductor 20, a plurality of two-project rope reels 30, a plurality of reel brakes 40, and a differential shaft brake 50.

The difference between the second embodiment and the first embodiment is as follows: only one motor 11 is provided when the power of the motor is large enough; wherein the output shaft of the motor 11 connects to a high speed input shaft 23 of the planetary differential reductor 20, and two high speed brakes 111, 112 are provided on the high speed input shaft 23.

As shown in FIGS. 1 and 2, the invention can carry out the synchronous operation of the two hanger tools and the separate operation of single hanger tool at either side.

According to the invention, the differential project shaft of the two planetary gear trains of the planetary differential reductor 20 are controlled by the first and second differential shaft brakes 51 and 52 of the two planetary machineries in order to achieve the control of the revolution of the land side reel and the sea side reel simultaneously, or the control of the revolution of the land side reel of the sea side reel individually, so that both the synchronous control of the land side hanger tool and the sea side hanger tool and the separate control of the land side hanger tool or the sea side hanger tool can be carried out.

When performing the synchronous operation of the two hanger tools:

All the differential shaft brakes 51 and 52 are in the braking state, and all the high speed shaft brakes 111, 112 and the reel brakes 40 are in the open state, the power of the motor 11 is output to the reels 31, 32 through the low speed output shaft of the planetary differential reductor 20 at same time so that two 40 (or 45) feet containers or a 40 (or 45) feet container and two 20 feet containers or four 20 feet containers can be lifted by the crane simultaneously;

When performing the operation of single side hanger tool:

One of the differential shaft brakes 51 and 52 is in the open state and another is in the braking state so that the power is only transferred to the reel whose reel brake is in the open state, and another reel whose reel brake is in the braking state does not receive the moment of the motor.

Based on the above description, it can be concluded that by using the planetary differential reductor having both sea and land outputs, that is, a set of motors and reductors connecting to two sets of the lifting machineries, the loading and unloading efficiency of the container shore crane is increased; further by using a planetary differential reductor and two differential shaft brakes, the revolutions of the two differential project shafts are controlled by the two differential shaft brakes, so that the operation of the individual reel can be controlled and the synchronous operation of two hanger tool or the separate operation of single hanger tool can also be carried out, meeting the requirement of the loading and unloading; in addition, since the two sets of the lifting machineries are driven by one set of the planetary differential reductor, the structure is simplified, the weight and the cost is reduced, and the maintenance is facilitated.

The invention claimed is:

1. A four-reel lifting machinery for a container crane for lifting two 40 feet containers simultaneously, comprising:

a plurality of motors;

a planetary reduction gear box having a plurality of high speed input shafts and a plurality of low speed output shafts, the high speed input shafts being connected to an output end of the plurality of motors;

a plurality of reels that each is connected to one of the plurality of low speed output shaft, a plurality of reels brakes mounted on the plurality of reels;

a plurality of high speed brakes mounted on the plurality of high speed input shafts; and a plurality of power distribution brakes mounted on the planetary reduction gear box for distribution of power outputted to each of the plurality of low speed output shafts.

2. The four-reel lifting machinery of claim 1, wherein:

the planetary reduction gear box has four low speed output shafts;

the plurality of low speed output shafts includes a first low speed output shaft and a second low speed output shaft, the first and second low speed output shafts are positioned on a first side of the planetary reduction gear box, each of which is connected to one of the plurality of reels, the reels that are connected to the first and second low speed output shafts have four ropes that are connected to a first spreader;

the plurality of low speed output shafts includes a third low speed output shaft and a fourth low speed output shaft, the third and fourth low speed output shafts are positioned on a second side of the planetary reductions gear box, each of which is connected to one of the plurality of reels, the reels that are connected to the third and fourth low speed output shafts have four ropes that are connected to a second spreader.

3. The four-reel lifting machinery of claim 1, wherein:

the four-reel type lifting machinery includes two motors;

the planetary reduction gear box has two high speed input shafts;

an output end of a first of the two motors is connected to a first of the two high speed input shafts;

an output end of a second of the two motors is connected to a second of the two high speed input shafts, and two of the plurality of high speed brakes are mounted on the second of the two high speed input shafts.

4. The four-reel lifting machinery of claim 1, wherein:

the four-reel type lifting machinery includes one motor;

the planetary reduction gear box has one high speed input shaft;

an output end of the one motor is connected to the one high speed input shaft, and two of the plurality of high speed brakes are mounted on the one high speed input shaft.

5. The four-reel lifting machinery of claim 1, wherein the plurality of reels brakes include two reels brakes which are mounted on each of the reels.

6. The four-reel lifting machinery of claim 1, wherein the plurality of power distribution brakes include first and second power distribution brakes, and the planetary reduction gear box has the plurality of low speed output shafts being divided into a first side and a second side;

the first power distribution brake is connected to the low speed output shafts of the first side and the second power distribution brake is connected to the low speed output shafts of the second side;

if both the first power distribution brake and the second power distribution brake are braked, the low speed output shafts of both sides are powered by the planetary reduction gear box; if the first power distribution brake is braked while the second power distribution brake is open, then the low speed output shafts of the second side are powered by the planetary reduction gear box and the low speed output shafts of the second side are unpowered; if the second power distribution brake is braked while the first power distribution brake is open, then the low speed output shafts of the first side are powered by the planetary reduction gear box and the low speed output shafts of the first side are unpowered.

* * * * *